United States Patent [19]

Fowler

[11] Patent Number: 4,503,577

[45] Date of Patent: Mar. 12, 1985

[54] PIPE AND HOSE DECONTAMINATION APPARATUS

[75] Inventor: David E. Fowler, Gainesville, Fla.

[73] Assignee: Quadrex HPS, Inc., Gainesville, Fla.

[21] Appl. No.: 388,492

[22] Filed: Jun. 14, 1982

[51] Int. Cl.[3] ..... B08B 9/02

[52] U.S. Cl. ..... 15/88; 15/40; 15/104.04; 134/64 R; 134/122 R

[58] Field of Search ..... 15/88, 40, 104.04, 97 R, 15/102; 134/64 R, 122 R, 9, 15; 29/81 B, DIG. 39, DIG. 63

[56] References Cited

U.S. PATENT DOCUMENTS

| | | | |
|---|---|---|---|
| 2,651,312 | 9/1953 | McBeth | 134/122 R |
| 3,227,629 | 1/1966 | Kearney et al. | 15/88 X |
| 3,306,310 | 2/1967 | Grant | 15/88 X |
| 3,491,778 | 1/1970 | Lehnert et al. | 134/122 R |
| 3,530,526 | 9/1970 | Schmidt | 15/88 X |

*Primary Examiner*—Edward L. Roberts
*Attorney, Agent, or Firm*—Bernard A. Reiter

[57] ABSTRACT

A pipe and hose decontamination apparatus is disclosed using freshly filtered high pressure Freon solvent in an integrated closed loop to remove radioactive particles or other contaminants from items having a long cylindrical geometry such as hoses, pipes, cables and the like. The pipe and hose decontamination apparatus comprises a chamber capable of accomodating a long cylindrical work piece to be decontaminated. The chamber has a downward sloped bottom draining to a solvent holding tank. An entrance zone, a cleaning zone and an exit drying zone are defined within the chamber by removable partitions having slotted rubber gaskets in their centers. The entrance and exit drying zones contain a horizontally mounted cylindrical housing which supports in combination a plurality of slotted rubber gaskets and circular brushes to initiate mechanical decontamination. Solvent is delivered at high pressure to a spray ring located in the cleaning zone having a plurality of nozzles surrounding the work piece. The solvent drains into a solvent holding tank located below the nozzles and means are provided for circulating the solvent to and from a solvent cleaning, distilling and filter unit.

25 Claims, 4 Drawing Figures

PIPE AND HOSE DECONTAMINATION APPARATUS

BACKGROUND OF THE INVENTION

This invention relates to decontamination of radioactive materials and in particular, to an apparatus using freshly filtered high pressure Freon solvent in an integrated closed loop circuit to remove radioactive particles or other contaminants from articles having a long cylindrical geometry such as hoses, cables, extension cords, pipes, electrical conduit, chains and other objects.

The nuclear power industry generates large quantities of tools, parts, hoses, pipes and maintenance materials that become radioactively contaminated during the normal course of their use. Those parts and materials which can be decontaminated by surface scrubbing and cleaning have been and are now being cleaned by a combination of scrubbing and high pressure water washing with a detergent. Hose and pipe and other work pieces having a long cylindrical geometry are particularly difficult to clean with current methods because of the surface geometry and length. As a result, an inordinate amount of time is expended in efforts to clean such elongate articles. In fact, it is frequently found to be less expensive to merely expend the part and resplace it than to try to decontaminate it.

The present invention is directed to the alleviation of these problems and provides an apparatus for the cleaning of radioactively contaminated pipe and hose and other materials having a long cylindrical geometry. There is here disclosed an apparatus which effectively decontaminates elongate articles quickly and inexpensively. Further, there is disclosed a method for decontaminating elongate articles with minimal potential operator time and experience.

SUMMARY OF THE INVENTION

The pipe and hose decontamination apparatus described herein comprises an enclosed insulated cleaning chamber capable of accomodating and receiving materials or work pieces having an elongate geometry into the interior of the chamber for decontamination of radioactive particles from the surface thereof. The enclosed chamber can be of varying shape, but in the preferred embodiment is rectangular with a downward slope bottom draining to a solvent holding tank. On the top of the cleaning chamber there is provided an access door with an observation window to view the work piece as it progresses through the interior of the chamber. The chamber is divided into three zones namely the entrance zone, the cleaning zone and the exit (drying zone) with the zones separated by removable parttitions having openings in their centers for the work piece to pass through. The entrance and exit drying zones are identical and both contain a horizontally disposed cylindrical housing having a plurality of slotted gaskets and circular brushes disposed within each cylindrical housing. The cylindrical housings serve both to support and guide the work piece as it moves through the chamber and to initiate mechanical decontamination. Also, they serve to prohibit solvent vapor escape from the chamber. The cleaning zone lies between the entrance zone and the exit zone and contains a spray ring having a plurality of nozzles attached thereto. Freshly filtered solvent is delivered at high pressure from a solvent cleaning, distilling and filter system similar to that which is the subject of pending U.S. patent application Ser. No. 228,971, now U.S. Pat. No. 4,443,269. The solvent is emitted through a high pressure hose to the spray ring and is sprayed out the nozzles onto the work piece as it progresses through the chamber. This high pressure spraying of solvent onto the work piece strips and/or dissolves the contaminants from the surface of the work piece and flushes them away. The spent solvent then passes by gravity through particle trays located below the work piece which trap any large particles and drains into the solvent holding tank where it is then transferred by a pump back to the solvent cleaning distilling and filter unit. Various valves, piping, hoses and quick disconnect fittings are employed to circulate the solvent through the cleaning chamber to accomplish the purpose and effect as outlined above. A cooling coil is disposed below the work piece and above the solvent holding tank inside the chamber in the cleaning section and is powered by a standard conventional mechanical refrigeration package. The cooling coil cools the solvent as it passes through and also cools the interior atmosphere of the cleaning chamber, thus keeping vapor losses to a minimum. The cooling coil also intercepts any vapors leaving the surface of the solvent holding tank, condenses them to a liquid, thus allowing them to gravitate back to the tank. A mobil stand is used to carry the cleaning chamber and also to house the mechanical refrigeration package, pump and other controls for the operation of the invention. Freon is used as the solvent, because it has been found that Freon provides a better solvent for the removal of oil, grease and other surface residue.

Numerous objects and advantages of this invention will become apparent upon a reading of the following detailed description when taken in connection with the accompanying drawings, wherein like numerals denote like parts in the various views and which illustrate the invention by way of example the preferred embodiment thereof.

DESCRIPTION OF THE PREFERRED EMBODIMENT

Figure 1:
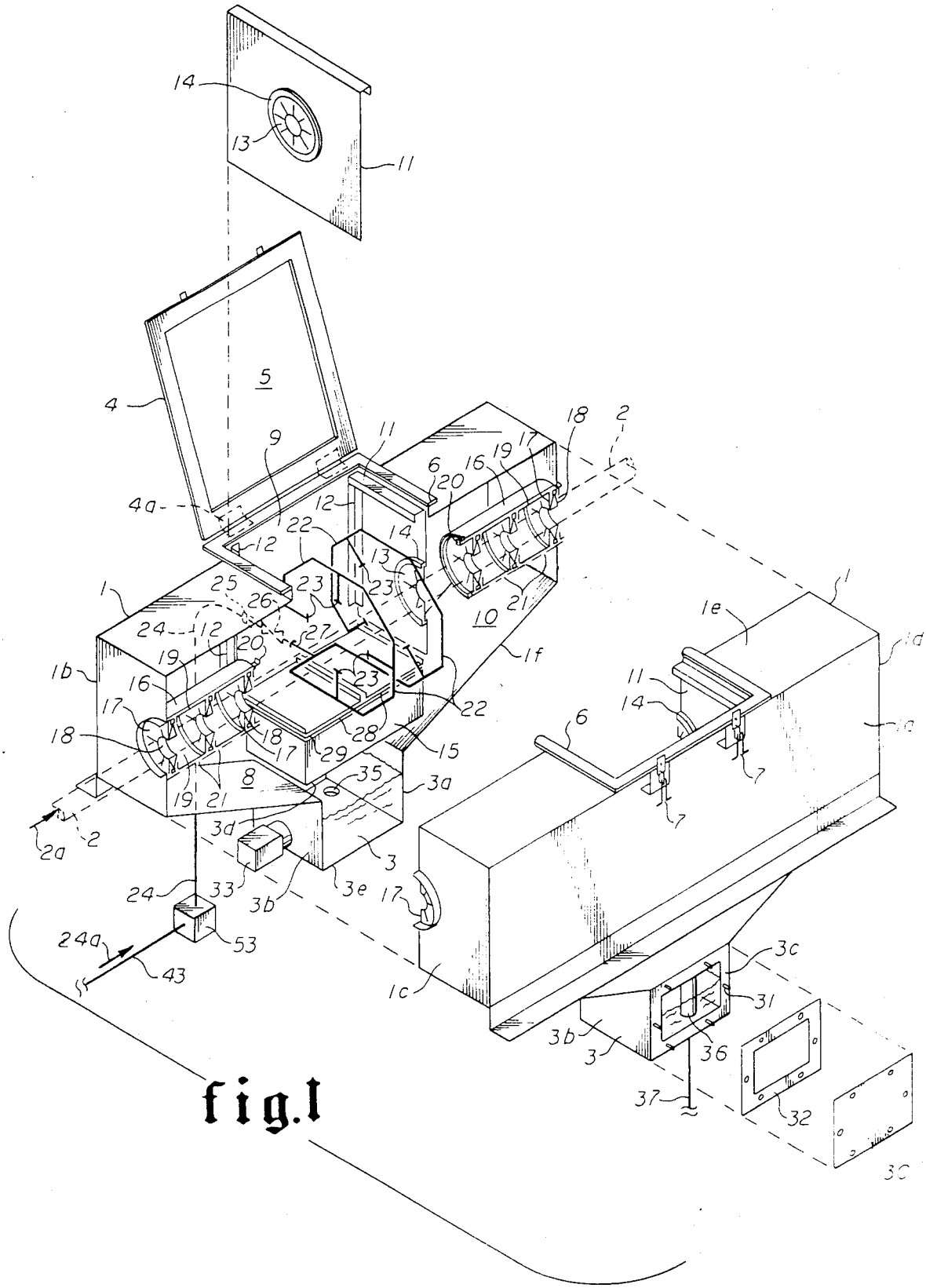
FIG. 1 is an exloded isometric view of the cleaning chamber according to the present invention.
Figure 2:
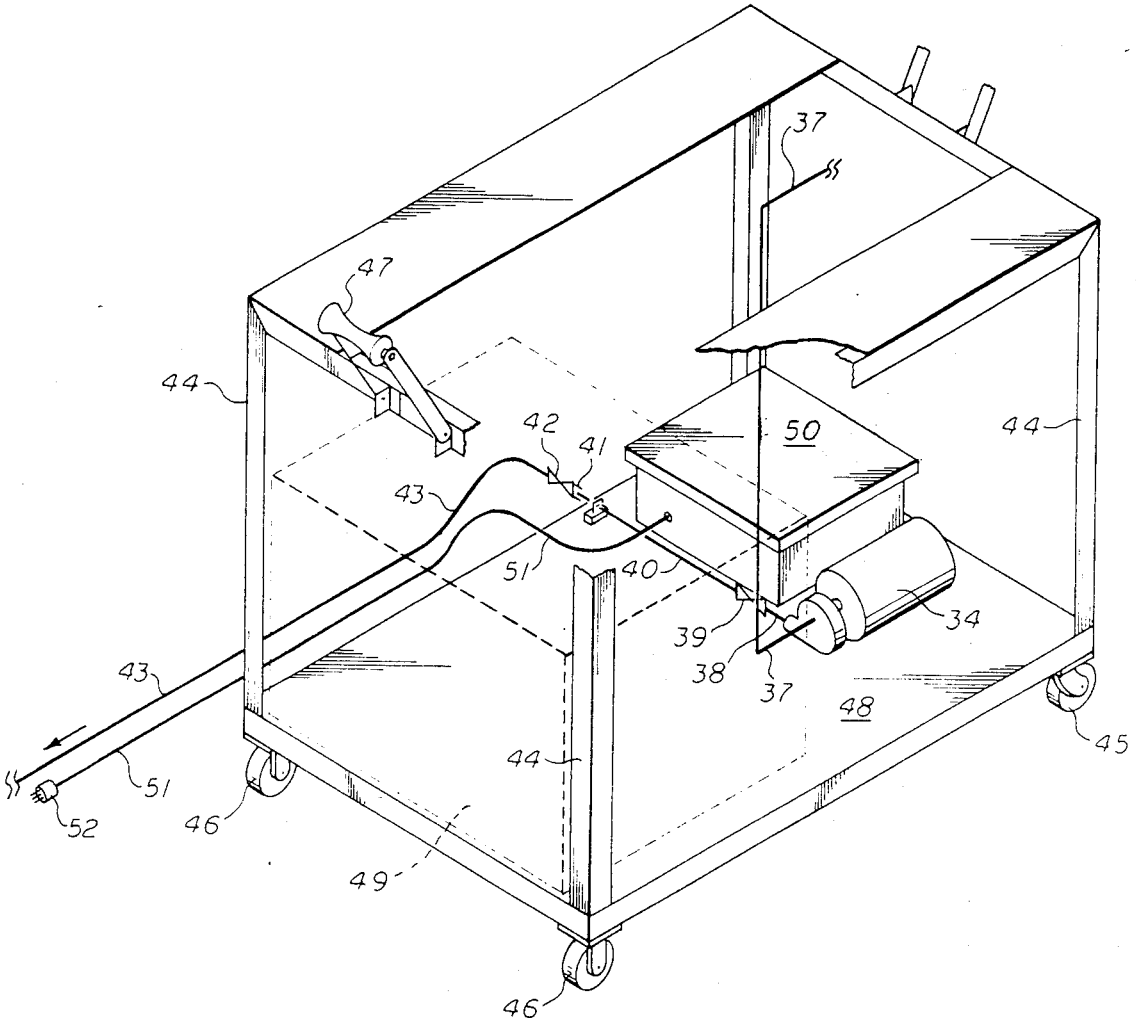
FIG. 2 is an exploded isometric view of the mobil stand used to support the cleaning chamber and ancillary items of the system.
Figure 3:
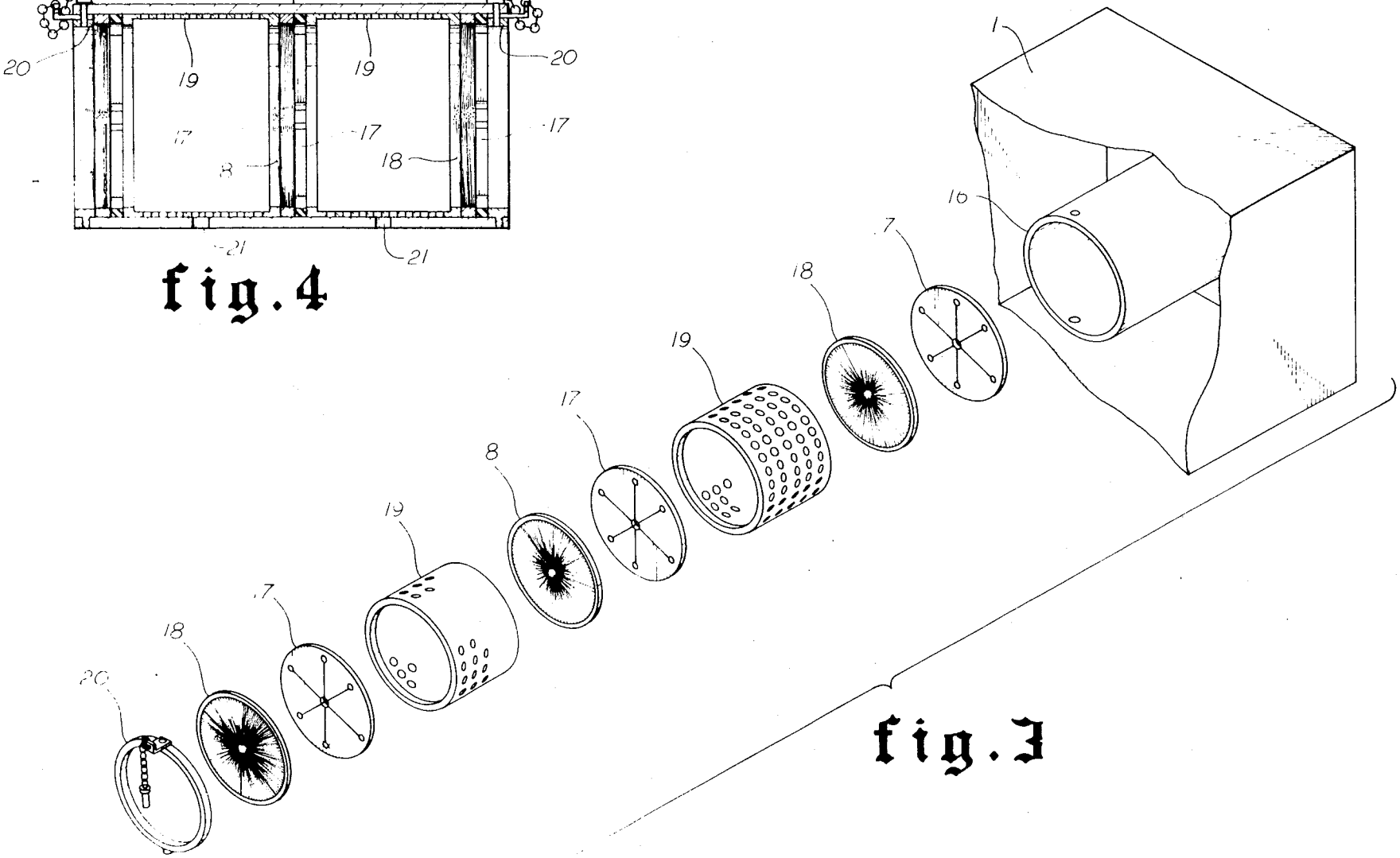
FIG. 3 is an exploded isometric of the brush-spacer assembly.
Figure 4:
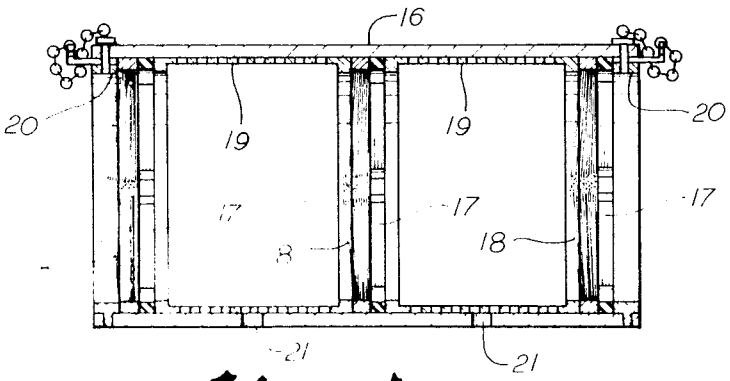
FIG. 4 is a cross-sectional view of the brush-spacer assembly.

Referring now to drawings, the pipe and hose decontamination apparatus is illustrated generally as chamber 1 in rectangular shape. The chamber 1 is not limited to any particular shape but is depicted as having two opposing side sections 1*a* and 1*b*, two opposing end sections 1*c* and 1*d*, a top section 1*e*, and a downwardly sloped bottom section 1*f*, all rigidly connected to accomodate a work piece 2 passing through the interior thereof. The downwardly sloped bottom section 1*f* is connected to a solvent holding tank 3 having opposing side sections 3*a*, 3*b*, 3*c* and 3*d* and a bottom section 3*e*. A chamber access door 4, having a transparent window 5 mounted in its center is hingedly connected through hinges 4*a* to the top section 1*e* of the chamber 1. Gasket 6 is mounted on the top section 1*e* of the chamber 1 to provide a solvent proof seal when the door 4 is in a closed position. Latches 7 are mounted on the side section 1*a* for securing the chamber access door 4 when it is in the closed and sealed position.

The cleaning chamber 1 is divided into three zones: the entrance zone 8, the cleaning zone 9, and the exit drying zone 10. These zones are defined by two removable partitions 11 that are held in place by two angular guides 12 rigidly connected to the chamber 1. Entrance zone 8 is defined from the end portion 1*c* to the chamber access door 4, and the exit drying zone is defined from the chamber access door 4 to the other end section 1*d*. The cleaning zone 9 is defined as the area directly beneath the chamber access door 4 and is further defined as being bounded by the opposing side sections 1*a* and 1*b*, and the removable partitions 11. Disposed in the center of each removable partition 11 is a slotted rubber gasket 13 held in place by a holding ring 14 rigidly attached to the removable partition 11. The slotted rubber gasket 13 supports and maintains the portion of the work piece and guides its movement as it enters and leaves the cleaning zone 9.

The entrance zone 8 and the exit drying zone 10 each have therein a horizontally mounted cylindrical housing 16 which among other purposes serve to support the work piece 2 as it moves through the chamber 1. Disposed within each horizontally mounted cylindrical housing 16 are the slotted rubber or other type gaskets, means 17 and circular brushes 18 mounted in such a fashion that the circular brushes 18 are positioned between the two slotted rubber gaskets 17. The circular brushes 18, positioned between opposing slotted rubber gaskets 17, are held in an axial position within the cylindrical housing 16 by circular spacers 19 positioned between each rubber gasket-circular brush-rubber gasket combination. The circular spacers 19 are perforated to allow scraped off debris to pass through them. The entire brush-gasket-spacer assembly is held in position within the horizontally mounted cylindrical housing 16 by pinned retaining ring 20 disposed in each end of each cylindrical housing 16. The horizontally mounted cylindrical housings 16 are also perforated or provided with drain holes 21 positioned at each circular spacer 19 to allow any condensed solvent to drain from the cylindrical housing 16 onto the sloped chamber bottom 1*f* and into the solvent holding tank 3.

Positioned and mounted within the cleaning zone 9 of the chamber 1 is a spray ring 22 having a plurality of nozzles 23 attached thereto. The nozzles 23 are equipped with fine mesh screens and interchangeable spray tips which determine the spray pattern and impact of the solvent onto the work piece 2. Flexibility in spray tip selection permits thorough and efficient cleaning of a variety of diameters and shapes of work pieces 2 being decontaminated. The spray ring 22 is so positioned and mounted within the cleaning zone 9 as to completely surround the work piece 2 and to ensure complete peripheral spraying of the solvent onto the work piece 2. The nozzles 23 can be slightly angled to prevent the spray from one nozzle impinging on the spray from adjacent nozzles and this angling of the nozzles produces an added advantage of providing a stripping action with respect to the work piece 2.

Freshly filtered solvent is delivered at high pressure from a solvent cleaning, distilling and filter unit 53 which is analogous to the subject of pending U.S. patent application Ser. No. 228,971, and is further related to U.S. Pat. No. 4,235,600, both assigned to the assignee hereof. The solvent is delivered from the solvent cleaning, distilling and filter unit 53 at high pressure through a high pressure hose 24 having a quick disconnect fitting 25 attached on its end which is connected to a shut off valve 26. Connected to the shut off valve 26 is a pipe or conduit 27 which connects to the spray ring 22 thus allowing the solvent to travel from the high pressure hose 24 to the spray ring 22 and out the nozzle 23 onto the work piece 2. As the solvent is directed onto the work piece 2, it strips and dissolves the contaminants from the surface and flushes them away. A particle tray 28 is mounted within the cleaning zone 9 and positioned below the spray ring 22 in order to trap any large debris or particles contained in the solvent as it leaves the surface of the work piece 2. This particle tray 28 can be removably mounted for periodic emptying. The spraying of the solvent at high pressure in the cleaning zone 9 causes some of the solvent to vaporize. To chill the expanding vapors and condense them back to liquid solvent, a cooling coil 15 is mounted within the chamber 1 in the cleaning zone 9 below the particle tray 28. A fine mesh screen 29 is mounted and positioned on top of the cooling coil 15 and below the particle tray 28 to prevent finer debris in the spent solvent from clogging the cooling coil 15. The cooling coil 15 is powered by a standard conventional mechanical refrigeration package 49. The coil 15 cools the spent solvent as it passes through it and also cools the interior atmosphere of the chamber 1, thus keeping vapor losses to a minimum and also functions to intercept any vapors leaving the surface of the solvent holding tank 3, condensing them to a liquid, thus allowing them to gravitate back to the solvent holding tank 3.

Drying of the solvent from the work piece 2 as it enters the exit drying zone 10 is accomplished by the fact that the solvent sprayed at high pressure in the cleaning zone causes some of the solvent to vaporize as mentioned earlier. This high pressure spraying of the solvent also causes a vaporized portion to expand and move toward the entrance and exit zones. As mentioned, the cooling coil 15 chills expanding vapors and condenses them back to a liquid form. This expanding and condensing cycle causes air currents to move from both the entrance zone and the exit zone downward toward the cooling coil 15, and this movement of air currents strips additional solvent from work piece 2 leaving it relatively dry.

As outlined above, the solvent holding tank 3 is positioned and located below the cleaning zone 9 and receives all the spent solvent. The solvent holding tank 3 has a transparent access cover 30 rigidly attached to the side 3*c* by a plurality of studs 31. A gasket 32 is positioned between the access cover 30 and the side 3*c* to form a solvent proof seal when the access cover 30 is in a closed position with respect to the holding tank 3. A plurality of wing nuts and washers are provided for securing the access cover 30 over the plurality of studs 31 in the conventional manner.

A solvent level switch 33 is mounted on a side of the solvent holding tank 3 to sense the level of the solvent in the solvent holding tank 3 and which functions to interrupt the power by conventional control cables not shown to a solvent transfer pump 34 at low solvent level and to return power to the solvent transfer pump 34 once a sufficient level is reached. A drain 35 is also provided in the bottom section 3*e* of the solvent holding tank to allow thorough draining of the solvent holding tank 3 at any desired time. A pump suction screen 36 disposed within the solvent holding tank 3 communicates to a suction conduit 37 which communicates to the solvent transfer pump 34. Solvent is drawn through the pump suction screen 36, through the suction conduit 37 and to the solvent transfer pump 34 and is pumped through a discharge conduit 38 leaving the solvent transfer pump 34 and going to a throttling valve 39 connected on the end of the discharge conduit 38. The throttling valve 39 is adjusted to regulate the flow of solvent leaving the solvent transfer pump 34 to the flow entering the solvent holding tank 3 and thus maintaining a constant solvent level in the solvent holding tank 3 which is observed by looking through the transparent access cover 30. Throttling valve 39 communicates through intermediate conduit 40 which terminates into a connector 41. Valve 42 communicates with connector 41 on one end and conduit 43 on the other end which returns the solvent back to the solvent cleaning, distilling and filter unit 53 to be cleaned, distilled and filtered before it is used again through the high pressure hose 24.

To support the chamber 1 at its optimum working height, a framework stand 44 is provided. The framework stand 44 can be moved in any desired location by the use of locking swivel wheels 45 and fix type wheels 46 mounted on the base 48 of the framework stand 44. Roller guides 47 are attached to the framework stand 44 which serve to align the work piece 2 at it enters and exits the chamber 1 and also serves to reduce the amount of effort required to pull the work piece 2 through the chamber 1.

Mounted on the base 48 of the framework stand 44 is a conventional electrical control box 50 which houses the necessary circuitry for the power and control of the solvent level switch 33, the solvent transfer pump 34 and the transformer and the thermal overload protection for the refrigeration package 49. Electrical power is supplied to the electrical control box 50 by way of electrical cord 51 and electrical plug 52.

While the invention has been described with reference to a preferred embodiment, it will be obvious to one skilled in the art that modifications and variations of the invention may be constructed and employed without departing from the scope of the invention. The scope of the invention is defined in the following claims.

I claim:

1. A decontamination apparatus for removing radioactive contamination from a work piece comprising:

a chamber having an entrance end and an exit end to accomodate a work piece through the chamber with the chamber further having a sloping bottom;

a solvent holding tank connected to the sloping bottom of said chamber and openly communicating with the interior of said chamber;

a first cylindrical housing mounted in the entrance end and extending into the interior of said chamber for supporting and guiding the work piece as it enters the chamber;

a second cylindrical housing mounted in the exit end and extending into the interior of said chamber for supporting the work piece as it exits the said chamber;

means for spraying solvent on the work piece as it progresses through the interior of the chamber with said spraying solvent means positioned around the periphery of the work piece so that solvent will be evenly distributed on the work piece;

means for circulating the solvent in a continuous loop through the spraying means.

2. The apparatus as defined in claim 1 wherein said first cylindrical housing and said second cylindrical housing each include a plurality of circular brushes axially positioned within said first cylindrical housing and said second cylindrical housing and held in position by a plurality of circular spacers positioned between each circular brush;

a retaining ring mounted on the ends of each said first cylindrical housing and said second cylindrical housing to maintain the plurality of circular brushes and circular spacers in an axial position within each said first cylindrical housing and said second cylindrical housing.

3. The apparatus as defined in claim 2 wherein each said first cylindrical housing and said second cylindrical housing further include a plurality of slotted rubber gaskets with each slotted rubber gasket positioned in front of and behind each circular brush.

4. The apparatus as defined in claim 3 wherein said spraying solvent means includes a spray ring mounted within said chamber having a plurality of nozzles attached thereto and positioned such that the plurality of nozzles will surround the work piece as it progresses through the chamber.

5. The apparatus as defined in claim 4 wherein said circulating solvent means includes a filter unit for cleaning, distilling and filtering the solvent as it circulates through the circulating solvent means.

6. The apparatus as defined in claim 5 wherein said circulating solvent means includes a high pressure hose connected to the filter unit on one end and having a quick disconnect fitting on the other end;

a shut-off valve communicating with the quick disconnect fitting and having a conduit attached to the other end of the shut-off valve with the conduit communicating with the spray ring.

7. The apparatus as defined in claim 6 further comprising a particle tray mounted in the interior of said chamber and positioned below the spray ring for collecting debris washed off of the work piece by the plurality of nozzles;

a fine mesh screen mounted in the interior of said chamber and positioned below said particle tray to further collect debris washed off the work piece by the plurality of nozzles spraying solvent on the work piece.

8. The apparatus as defined in claim 7 wherein said solvent holding tank includes a first side having an opening therein;

a plurality of studs extending from the first side to receive and communicate with a transparent access cover;

a gasket positioned around said plurality of studs and between the first side of said solvent holding tank and the transparent access cover to provide a solvent proof seal.

9. The apparatus as defined in claim 8 wherein said circulating solvent means includes a pump suction screen positioned within said solvent holding tank;

a suction conduit communicating on one end with said pump suction screen and on the other end to the solvent transfer pump;

a discharge conduit communicating on one end to the solvent transfer pump and having a throttling valve attached to the other end of the discharge conduit for controlling the amount of solvent circulating through the circulating solvent means;

an intermediate conduit communicating on one end to the throttling valve and having a connector rigidly attached to the other end;

a valve communicating with the connector on one end and connected to a conduit on the other end with the conduit communicating with the filter unit.

10. The apparatus as defined in claim 9 further comprising a solvent level switch attached to and positioned on a side of the solvent holding tank for sensing the level of the solvent within said solvent holding tank;

means for supplying electrical control signals to said solvent transfer pump from said solvent level switch so that when the solvent in said solvent holding tank reaches a desired level, said solvent transfer pump will stop pumping and when the level of the solvent in said solvent holding tank rises above the desired level, the solvent transfer pump will start pumping.

11. The apparatus as defined in claim 10 wherein said chamber further includes a top section having an opening therein;

a chamber access door having a transparent observation window disposed therein with said chamber access door hingedly mounted on said chamber for closing over the opening;

latches mounted on said chamber for securing the chamber access door over the opening;

a gasket mounted around the periphery of the opening and disposed between the top section and the chamber access door to provide a solvent proof seal.

12. The apparatus as defined in claim 11 further comprising a first angular guide mounted within the interior of said chamber and positioned below the opening in the top section and further positioned on one side and parallel to the spray ring;

a second angular guide mounted within the interior of said chamber and positioned below the opening in the top section and further positioned on the other side and parallel to the spray ring.

13. The apparatus as defined in claim 12 further comprising a first removable partition slidably engaged into said first angular guide with said first removable partition having a slotted rubber gasket disposed in its center held in place by a holding ring for supporting and guiding the work piece as it moves through the interior of said chamber;

a second removable partition slidably engaged into said second angular guide with said second removable partition also having a slotted rubber gasket positioned in its center held in place by a holding ring for further supporting and guiding the work piece as it moves through the interior of said chamber.

14. The apparatus as defined in claim 13 further comprising means for cooling the solvent as it drains into said solvent holding tank.

15. The apparatus as defined in claim 14 wherein said solvent cooling means includes a cooling coil mounted within the interior of said chamber and above said solvent holding tank and below the fine mesh screen;

means for providing coolant to said cooling coil so that said cooling coil will cool the solvent as it drains into said solvent holding tank.

16. The apparatus as defined in claim 15 wherein said coolant providing means includes a refrigeration package communicating with said cooling coil.

17. The apparatus as defined in claim 16 further comprising a framework stand for supporting said chamber having wheels attached to said framework stand for providing mobility to said framework stand;

a plurality of roller guides attached to said framework stand and positioned in front of the entrance end of said chamber and behind the exit end of said chamber for supporting and guiding the work piece into and out of said chamber.

18. A decontamination apparatus for receiving a contaminated work piece through an opening at one end thereof, for cleaning said work piece and for removing the work piece from the exit end thereof comprising:

a chamber having an entrance end and an exit end to accommodate a work piece to be transmitted through the chamber from said entry and to said exit end, the chamber having a bottom;

a solvent holding tank communicating with said bottom;

a first cylindrical housing means mounted proximate the entrance end for supporting and guiding the work piece as it enters the entry end;

a second cylindrical housing means mounted proximate the exit end for supporting the work piece as it exits the exit end;

means for spraying solvent on the work piece as it progresses through the interior of the chamber, said solvent spraying means positioned around the periphery so that the solvent will be evenly distributed thereon; and means for circulating the solvent in a continuous loop through the spraying means and for collecting the solvent at the bottom of the chamber.

19. A decontamination apparatus for removing contamination from a work piece comprising a chamber consisting of an entry zone and into which the work piece is introduced, a solvent cleaning tank communicating with the chamber and separated therefrom;

an exit chamber through which the work piece leaves the decontamination apparatus and communicating with the solvent tank;

a first cylindrical housing means mounted in the entry chamber and extending thereinto and through which the work piece moves into the solvent cleaning tank;

a second cylindrical housing means mounted in the exit chamber and through which the work piece moves upon leaving the decontamination apparatus; said first cylindrical housing means and said second cylindrical housing means including cleaning means which serve to support and guide the work piece and to assist in the cleaning thereof prior to and after the treatment of the work piece in the solvent cleaning tank;

means for spraying solvent on the work piece as it progresses through the interior of the cleaning chamber; and means for continuously circulating solvent in a closed loop conduit system to be used again thereafter in spraying a work piece.

20. The apparatus of claim 19, wherein said spraying solvent means includes a spray ring mounted within said chamber having a plurality of nozzles attached thereto and positioned such that the plurality of nozzles will surround the work piece as it progresses through the chamber.

21. The apparatus of claim 19, wherein said first housing and said second housing cleansing means each include a plurality of circular brushes axially positioned within said first housing and said second housing and held in position by a plurality of spacers positioned between each circular brush;

a retainer ring mounted on the ends of each said first housing and said second housing to maintain the plurality of circular brushes and circular spacers in an axial position within each said first and second housings.

22. The apparatus of claim 19 which further comprises a particle tray mounted in the interior of said chamber and positioned below the spray ring for collecting debris washed off the work piece by the nozzles;

a screen mounted in the interior of said chamber and positioned below said particle tray to further collect debris washed off the work piece by the nozzles spraying the solvent on the work piece.

23. The apparatus of claim 19 wherein said circulating solvent means includes a pump suction screen positioned within said solvent tank;

a suction conduit communicating on one end with said pump suction screen and on the other to the solvent transfer pump;

a discharge conduit communicating on one end to the solvent transfer pump and having a throttling valve attached to the other end of the discharge conduit for controlling the amount of solvent circulating through the circulating solvent means;

an intermediate conduit communicating on one end to the throttling valve and having a connector rigidly attached to the other end;

a valve communicating with the connector on one end and connected to a conduit on the other end with the conduit communicating with the filter unit.

24. The apparatus of claim 19, wherein said chamber further includes a top section having an opening therein;

a chamber access door hingedly mounted on said chamber for closing over the opening; and gasket means mounted around periphery of the opening and disposed between the top section and the chamber access door to provide a solvent proof seal.

25. A decontamination apparatus for removing contamination from an elongate work piece comprising:

a chamber having an entrance end and an exit end, each said entrance and said exit end enclosing an elongate cylindrical housing means mounted therein and extending toward the interior of said chamber and for supporting and guiding a work piece into and out of the chamber, said elongate housing means being axially aligned with one another;

spray means mounted in the chamber between each said elongate housing means for spraying the periphery of the work piece as it moves therethrough;

each said cylindrical housing means being characterized by removable brush means for contacting the work piece and assisting in the cleansing thereof as it moves into and out of the chamber, said spraying means being positioned intermediate the first and second housing means;

means for collecting the solvent after it is sprayed on the work piece and recirculating it in closed loop fashion so as to enable reuse thereof; and partition means mounted in the apparatus and partially isolating the first and second housing means from the spraying means as the work piece moves therethrough.

* * * * *